US005447000A

United States Patent [19]

Larsen

[11] Patent Number: 5,447,000

[45] Date of Patent: Sep. 5, 1995

[54] PREFABRICATED BUILDING KIT

[76] Inventor: Peter W. Larsen, Residence Quatre Soleils, CH-3974 Mollens, Switzerland

[21] Appl. No.: 111,215

[22] Filed: Aug. 24, 1993

Related U.S. Application Data

[63] Continuation-in-part of Ser. No. 678,985, Apr. 30, 1991, abandoned.

[51] Int. Cl.[6] ..... E04H 5/06

[52] U.S. Cl. ..... 52/79.1; 52/79.5; 52/234; 52/DIG. 9

[58] Field of Search ..... 52/79.1, 79.5, 79.9, 52/234, DIG. 9

[56] References Cited

U.S. PATENT DOCUMENTS

| | | | |
|---|---|---|---|
| 3,792,558 | 2/1974 | Berce et al. | 52/79.1 |
| 3,945,157 | 3/1976 | Borys . | |
| 3,983,665 | 10/1976 | Burton | 52/79.1 |
| 4,083,154 | 4/1978 | Klink | 52/79.9 |
| 4,545,171 | 11/1985 | Colvin | 52/79.5 |
| 4,635,412 | 1/1987 | Le Poittevin | 52/79.5 |
| 4,640,412 | 2/1987 | Skvaril . | |
| 4,644,708 | 2/1987 | Baudot et al. | 52/79.1 |
| 4,854,094 | 8/1989 | Clark | 52/79.1 |
| 4,891,919 | 1/1990 | Palibroda | 52/79.5 |
| 5,193,325 | 3/1993 | Allison | 52/79.9 |
| 5,317,857 | 6/1994 | Allison | 52/79.9 |

FOREIGN PATENT DOCUMENTS

| | | | |
|---|---|---|---|
| 2519841 | 11/1975 | Germany . | |
| 2854571 | 6/1980 | Germany . | |
| 2075083 | 11/1981 | United Kingdom | 52/79.5 |

*Primary Examiner*—Carl D. Friedman
*Assistant Examiner*—Wynn E. Wood
*Attorney, Agent, or Firm*—Ostrolenk, Faber, Gerb & Soffen

[57] ABSTRACT

A containerized prefabricated building kit comprises a cuboidal frame having eight corners and twelve edges the corners being provided with standard container handling equipment components, allowing the kit to be transported as a standard shipping container. The structure of the container kit consists substantially only of components of the prefabricated building kit. The cuboidal frame is used in the building, either after separating it into its components, that is into separate beams or by using the open sided frame as the frame work for a side room or other part of the building.

19 Claims, 6 Drawing Sheets

PREFABRICATED BUILDING KIT

BACKGROUND OF THE INVENTION

This application is a continuation-in-part of Ser. No. 07/678,985, filed Apr. 30, 1991, now abandoned (derived from PCT/GB89/01127 filed 26 Sep. 1989).

FIELD OF THE INVENTION

The present invention relates to a kit of components for producing a prefabricated building which is formed into a transportation unit which is capable of being transported by machinery designed for transporting standard containers.

DESCRIPTION OF PRIOR ART

It is known, e.g., from U.S. Pat. No. 3,945,157 (DE 2,063,109) and DE 2,854,571, to provide such a kit in the form of a transportation container constructed from the kit. The walls of the container are formed of trays consisting of partially preassembled end and side walls of the eventual building. Accordingly there is inevitably a lot of wasted space in the container, and there are severe restrictions on the size of building that can be transported if the container is to be of conventional size.

In DE-A-2519841 a kit for a prefabricated building in knock-down form comprises a top and bottom frame, each with panelling permanently attached via the entire area of the frame and which are fitted one above the other. In the kit the two frames are secured to one another using L-section vertical beams which fit into recesses in the corners of the frames, with the reverse angle of the beam section facing inwards. Between the two frames in the kit are placed other components of the prefabricated building, in particular wall panels which lie horizontally, between the top and bottom frames. When the building is erected, the bottom frame of the kit becomes the floor of the building and the top metal frame is supported on longer upright beams vertically adore the bottom frame, to form the roof of the building. The floor areas of the kit and of the building itself are therefore equal. The roof of the building can only be horizontal. No provision is described to allow the kit itself to be maneuvered with readily available lifting equipment.

In U.S. Pat. No. 4,640,412 prefabricated floor or ceiling units, comprising a panel with perpendicularly arranged strengthening support members, are designed so that two half units can be nested one inside the other in face to face relationship. A pack may contain two such half units and four vertical support members with two perimetrical beam members. The nested unit may be provided with means to secure the two half panels to one another for transport. The use of lifting hooks, passing through circular apertures to engage with a recess in a component of one of the panels is described. The panels apparently remain horizontal during transport.

In U.S. Pat. No. 4,854,094 there is described a method of converting shipping containers which can no longer be used for transport purposes into habitable dwellings. The shipping containers used as the starting point for the method include fixed side walls and end walls and the specification describes how those walls are retained and made use of in the final building. Although more than one shipping container may be positioned adjacent one another to form the final building, the total floor area of the building is limited to the total floor area of the containers from which it is formed.

OBJECTS OF THE INVENTION

An object of this invention is to provide a kit for a prefabricated building which can be handled and transported by readily available lifting and transportation means.

Another object of the present invention is to provide a kit for a prefabricated building which is compact in volume. Another object is to provide a compact kit which includes components for a building having a floor area which is many times larger than the floor area of the kit.

Another object of the present invention is to provide a kit of components for producing a prefabricated building in which the individual components can be lifted without the use of mechanical lifting devices, for instance by one or two persons.

An object of a preferred embodiment of the invention is to provide a prefabricated building from a kit including a cool side room.

SUMMARY OF THE INVENTION

The above and related objects of this invention are achieved with the novel containerized prefabricated building kit comprising:

a) a cuboidal frame having 8 corners and 12 edges;
b) 2 side walls;
c) floor; and
d) roof;
e) said cuboidal frame consisting of
  i) 8 corner box units, one of which is positioned at each of the 8 frame corners, each being box-shaped with 6 faces and having 3 external faces which face outwards from the cuboidal frame and 3 internal faces and
  ii) 12 elongate beams forming said frame edges, each of which has first and second ends, said first and second ends each being rigidly secured to one internal face of a respective corner box unit;
f) in which said cuboidal frame is at least 2.6 m high;
g) said side walls each being formed by several kit wall panels each having an area of less than 6 $m^2$ each being removably attached to said frame;
h) said front and back walls and roof and floor being formed of components which are not permanently secured to said frame;
i) said kit further containing a plurality of building panels for use in the prefabricated building as building wall panels, floor panels and roof panels;
j) said kit further containing a plurality of building beams for use in the prefabricated building as structural load bearing components;
k) in which said prefabricated building has a total floor area which is more than twice the area of the floor of the containerized kit.

In the invention there is further provided a novel method of erecting a building from prefabricated components, comprising the steps of:

1) providing the said components in the form of the containerized kit,
2) dismantling the containerized kit by removing said building panels and said building beams, and attaching said kit wall panels from said frame, and
3) erecting the said building from said building panels, building beams and kit wall panels to form a building having external walls and a roof, in which the wall the floor area of the building bounded by the said external walls is more than twice the floor area of the containerized kit.

In the invention the floor area of the building formed from the kit is preferably at least four times the floor area of the respective containerized kit.

In general one building, for instance having a floor area of about 100 $m^2$ is provided in the form of a single standard 20 foot (6.058 meter) container. For smaller buildings a single container of that size may comprise sufficient components for building two or three buildings for instance simple shelters each having a floor area of about 45–50 $m^2$. For larger buildings a longer transportation unit may be required or, two transportation units may be required.

The corner box units of the containerized kit invention are constructed so as to be able to be secured to standard shipping container handling equipment. The apertures in the external face or faces of the corner box units are generally rectangular in shape, optionally with rounded corners. Preferably there are apertures in at least two and more preferably each of the external faces. The apertures in the box units at the upper corners of the cuboidal frame enable standard twist-lockable container lifting equipment to be admitted to allow the containerized kit to be lifted. The apertures in the box units at the bottom corners of the cuboidal frame allow admission of standard twist-lockable handling equipment, so that the containerized kit may be secured for transport, for instance in a ship, on a road or rail truck.

These corner structures are generally formed of steel, for instance 5–6 mm gauge steel, and are connected to the beams forming the frame of the transportation unit either by being bolted or may be integral with the beams for instance they may be welded together.

In some cases these or other corner structures for the frame may be components of the prefabricated building. For instance, they may be used for internal features of the building. However in some cases they may have no function in the building. In a preferred embodiment, each corner structure is welded to the three frame beams which meet at that corner. Usually the corner piece is removed from those beams before the beams are used in the structure of the building, for instance may be severed from the beams using conventional equipment, for instance a disc grinder.

The size of the transportation unit must be such that the unit can be carried by lorries and other vehicles designed for the carriage of conventional containers, and so normally has substantially the same size as a conventional container. A conventional container is about 2–3 m high and about 2.44 m (nominally 2.435 m) wide and, usually, about 6.06 m (nominally 6.058 m) long or sometimes shorter (eg about 4.5 m) or longer (eg 12.1 m). Preferably the unit has substantially the size and shape of a container of the type known as a High Cube Container (or a Supercontainer) and which preferably has a height of at least about 2.6 m and up to about 3 m, for instance about 2.9 m, and often a length of 12.11 m.

The cuboidal frame may be separated to form at least twelve elongate beams ie from the twelve frame members when the kit is dismantled and the building erected.

The elongate beams of the cuboidal frame are preferably L-section. The beams are preferably arranged so that the reverse (that is more than 180° ) angle of the L-section faces outwards from the cuboidal frame.

Each frame edge preferably comprises a single elongate beam for maximum strength and stability of the unit, although for the longest edges, it may be necessary to join two or more beams together. In general each component is capable of being carried by one or, at most, two persons.

The beams forming the edges of the transportation unit are subsequently used in the prefabricated building. In the embodiment of the invention in which the cuboidal frame is separated into several beams these may be used for instance as part of a portable foundation which is placed directly on the ground and supports the rest of the building, but preferably the beams are stabilising components for attaching horizontally across the tops of the walls and for attachment of the roof trusses. Alternatively, the beams may comprise roof supports for the building or may comprise vertical corner units.

In an alternative embodiment of the method of the invention the cuboidal frame is retained as such in the final prefabricated building and is used as a structural element in the building. It may for instance be used as a side room, usually with an independent entry. In a preferred aspect the cuboidal frame is sunk into the ground to a depth of at least 0.2 m, preferably at least 0.4 m, and the recessed part of the side room usually the horizontal base allows transmission of moisture from the ground into the interior of the side room. By this means the side room is kept cool so that it is useful for storage of food and drink.

In the transportation unit, the kit wall panels are secured to the cuboidal frame so that they act as stabilising means for the frame. Usually a single panel is attached to both the top and bottom edges of the cuboidal frame side faces. The panels may be secured to the elongate beams by, for instance, being bolted directly thereto, or by providing connectors with means for attaching to both the panels and to the beams. As an alternative to stabilisation by attaching panels into the frame, the transportation unit can be stabilised by the provision of diagonal struts between edges of the frame, preferably connected as near as possible to the ends of the edges. Usually it is advantageous for the floor of the transportation unit to have such diagonal struts, and for additional stability the ceiling and/or long walls (ie, side walls) may have such struts. Conveniently these diagonal struts may be provided by beams that may be preformed triangular roof trusses. These may be secured to the edges of the transportation unit by bolts, for instance which are subsequently used in the building. Generally the floor of the transportation unit is supported by horizontal cross pieces fixed between the horizontal edges of the lower part of the frame.

The floor, walls and top of the transportation unit are generally provided by panels, which may subsequently be used in the building as wall panels, floor panels or roof panels. Usually the external surfaces of the walls, floor and top of the transportation unit are provided by panels subsequently to be used as roof covering or wall fascia panels for the building. They are for instance made of plywood and are strong and cheap and so unlikely to suffer expensive damage during transportation of the unit and thus protect the more: sensitive wall panels stacked behind them. The transportation unit may be protected by an outer covering, for instance of sheets of plastics material, primarily to protect it from the elements especially rain.

Preferably substantially all individual or preassembled panels are flat, so as to facilitate close packing of the entire container, although wall corner panel units (e.g., consisting of two narrow panels at right angles to each other) may be included. Preferably one or more faces of the unit are formed from a plurality of separate panels in side-by-side relationship.

Preferably the transportation unit is formed and packed so that it can be dismantled from the inside outwards only and so that as the components are removed they can be used substantially in sequence to construct the building.

Thus the components are packed into the transportation unit so that they may be removed in the order in which they are required for constructing the building. This minimises the time required for erection of the building and avoids the necessity of repacking the transportation unit should construction have to be halted at any time before its completion. Thus preferably the foundation and wall members of the building can be removed from within the unit before having to dismantle the frame of the unit.

In a preferred embodiment, the transportation unit is provided with an entrance door, for instance in the front or rear wall, which can be locked, for instance before or whilst the transportation unit is being dismantled. This door should be the only entrance to the transportation unit and thus must be sufficiently large for the components to pass through. Preferably the door is subsequently used as a door component in the building structure.

Sometimes the transportation unit may also contain items of furniture for the interior of the building, generally in knock down form for subsequent assembly. For instance there may be storage units, beds, tables, chairs and items of kitchen furniture etc.

The buildings which are produced may be residential units or may be commercial or industrial units or may be public service buildings such as schools, hospitals etc. The invention is of particular use for providing emergency shelter accommodation for areas where these are required, for instance, where homes have been destroyed by natural causes or where there are large numbers of refugees to be accommodated. The transportation units are easy to transport by conventional container equipment and the prefabricated buildings are in general simple and quick to construct, even by unskilled workers. The invention is also of use for provision of temporary buildings which need to be dismantled after use and repacked and re-erected elsewhere. Since, in the preferred embodiment, all of the components of the transportation unit, and in particular its frame, form part of the structure of the building, these components are available for reconstruction of the transportation unit on dismantling of the building. It may be necessary to weld components back together which had previously been severed; for instance the beams forming the frame of the unit may have to be welded to their respective corner units.

DETAILED DESCRIPTION OF THE INVENTION

Preferred embodiments of the invention are illustrated in the following drawings in which.

Figure 1:
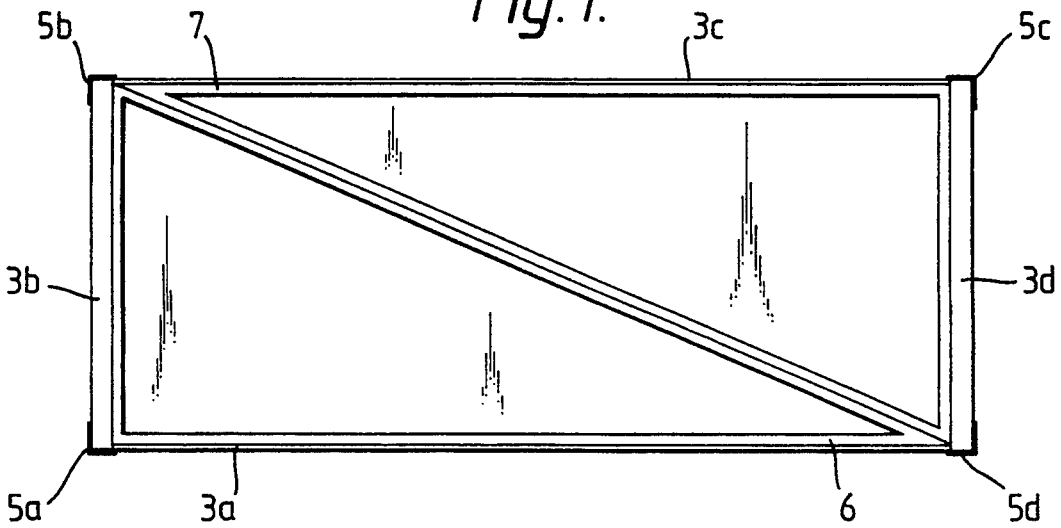
FIG. 1 is a plan view of the floor of a transportation unit.
Figure 2:
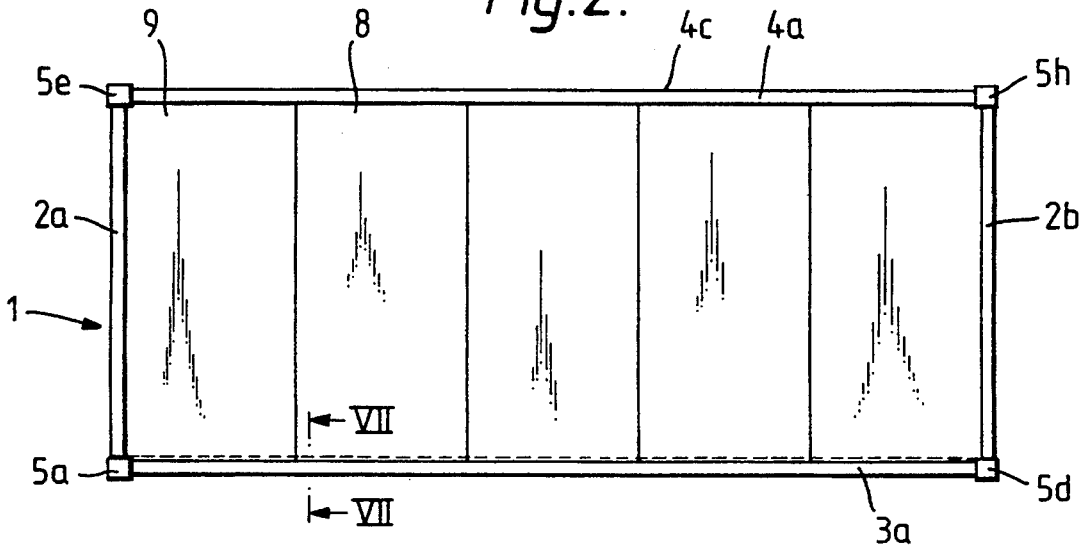
FIG. 2 is a side view of a transportation unit.
Figure 3:
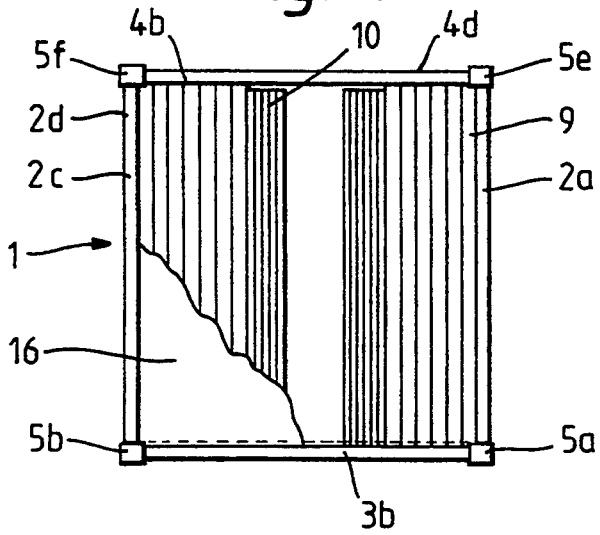
FIG. 3 is an end on view of a transportation unit.

FIGS. 1, 2 and 3 are schematic illustrations of a transportation unit 1 packed and ready for transporting. The unit consists of a frame formed from vertical beams 2*a* to 2*d*, bottom horizontal beams 3*a* to 3*d* and top horizontal beams 4*a* to 4*d*, held together by eight corner pieces, 5*a* to 5*h*, which in this case are welded to the respective beams. The beams all have L-section and are formed of 5–6 mm gauge steel. The bottom rectangle of the frame formed by horizontal beams 3*a* to 3*d* is stabilised by diagonal struts, comprising two triangular roof trusses 6 and 7 that are bolted to the beams. Preferably underneath the roof trusses 6 and 7 there is provided a protective layer across the entire floor area of the transportation unit, for instance formed of sheets of plywood (illustrated in FIGS. 6 and 7). These plywood sheets are subsequently used as part of the roof covering for the house.

The long side walls of the transportation unit are provided by building wall panels 8 and 9. Preferably, as shown in FIG. 3, there is a protective layer of plywood sheet 16 used as the external wall of the transportation unit. Such sheets may also be used across the floor and roof of the transportation unit.

FIG. 3 shows an end view of a packed transportation unit showing the wall panels stacked vertically at each side of the container and also showing other components of the building, generally illustrated as 10, stacked in the container. These other components may be further roof trusses, further roof panels or external wall fascias or floor panels used in the building. A preferred building comprises a portable foundation formed from a number of beams and, since these are required in the first stages of erecting the building, they may also be placed in the area 10. The end walls may be provided with a protective layer of plywood 16, which prevents components being lost or removed during transport, as may the roof of the unit.

Figure 4:
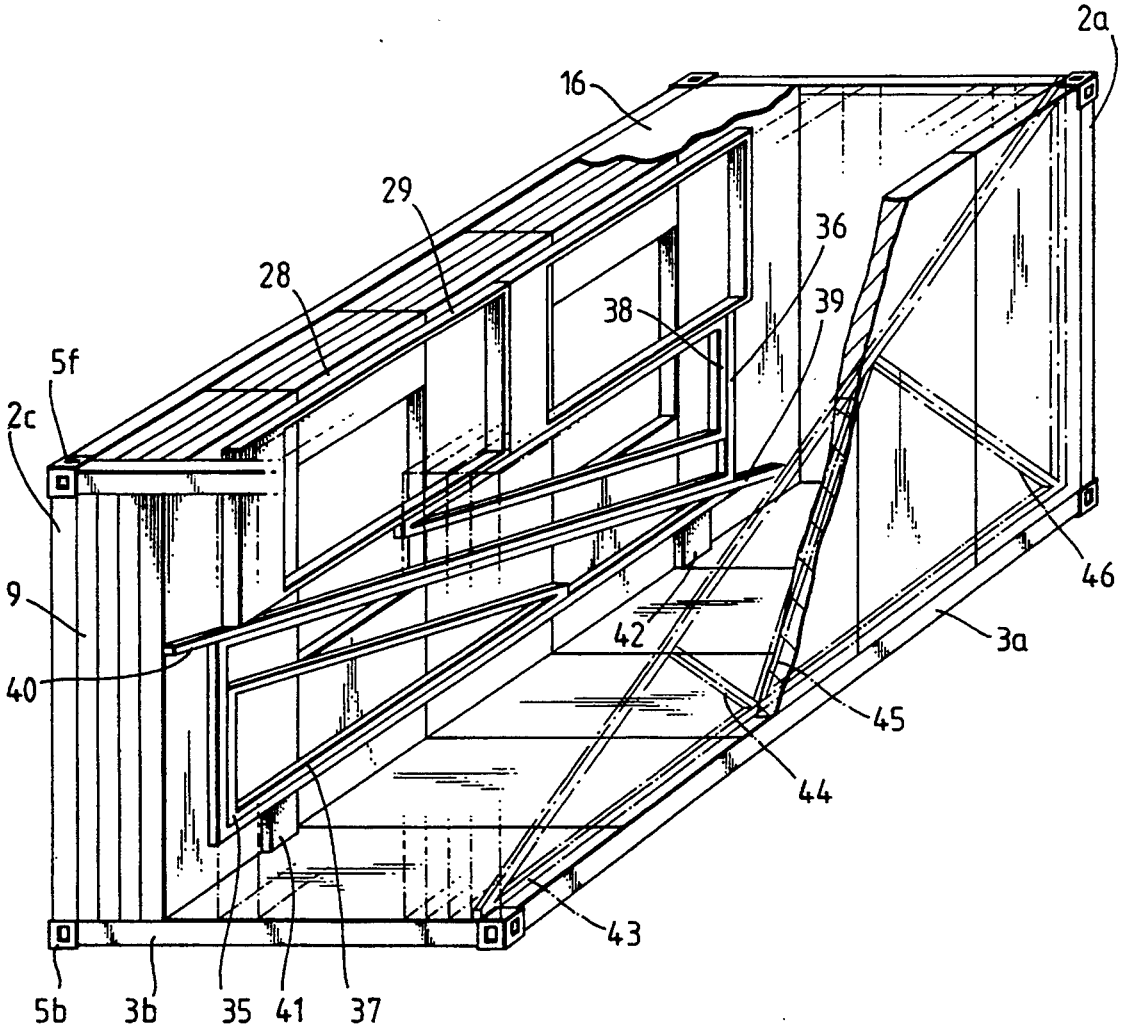
FIG. 4 is a partially cut away perspective view of a transportation unit.

In the embodiment of transportation unit illustrated in FIG. 4, along one longitudinal wall there are stacked a number of wall panels 9, some of which have window openings 28, and others of which have door openings 29. Also packed in the unit are preformed triangular roof trusses including large roof trusses 35 and 36 and, fitted inside these, smaller roof trusses 37 and 38. In the embodiment illustrated the large beams 35 and 36 have extensions 39, 40 for supporting the eaves of the building, and so are supported in the transportation unit on props 41 and 42. There is shown by broken lines one larger roof truss 43 which is secured to the frame near to the other longitudinal wall and acts as a stabilising strut for the structures of the transportation unit by being bolted to beams. This roof truss has additional struts 44, 45 and 46 to give it further strength. The shorter roof trusses are used for the construction of roofs having four inclined surfaces, for instance pyramidal roofs.

Figure 7:
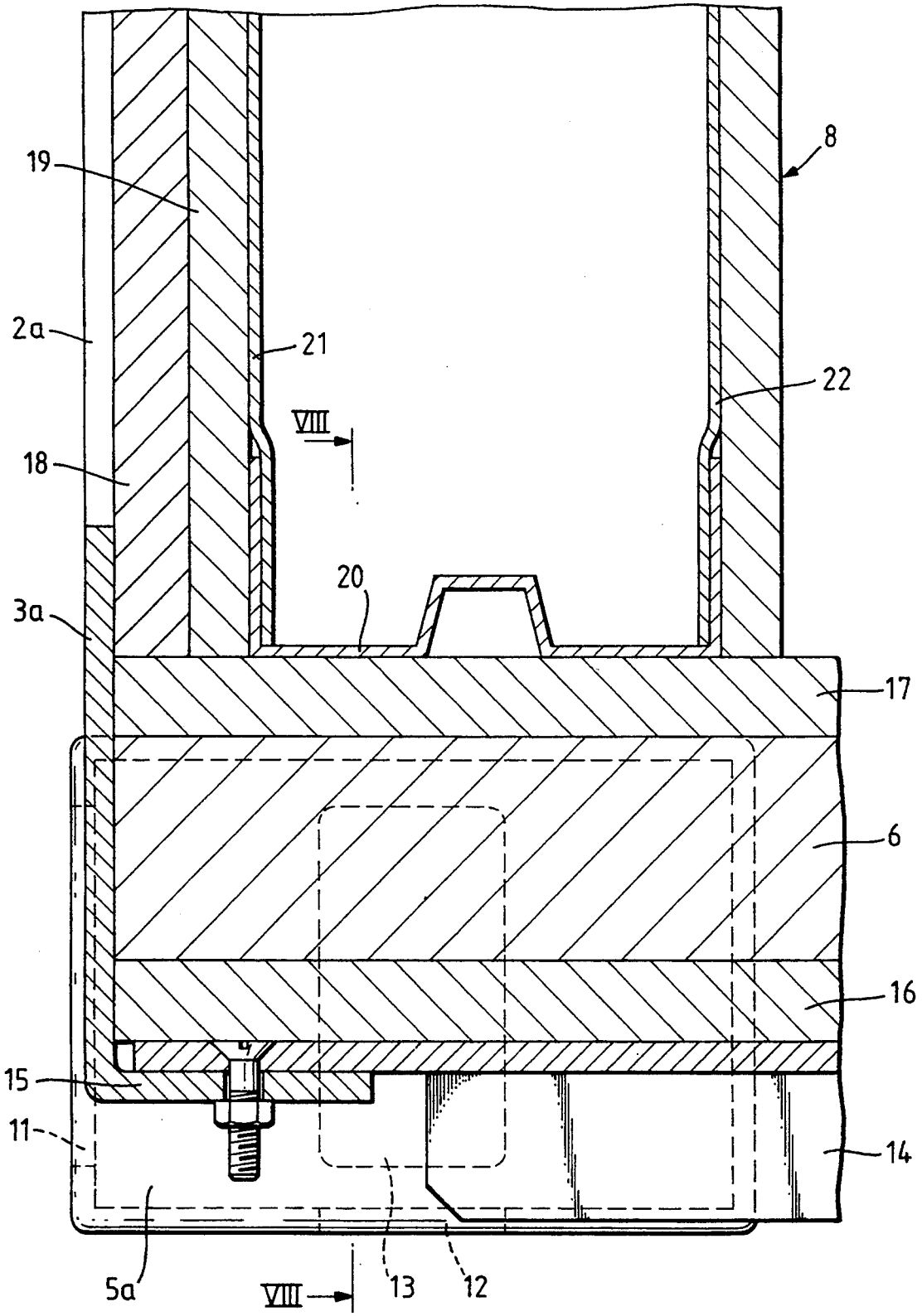
FIG. 7 is a cross-section along line vii—vii in FIG. 2.
Figure 8:
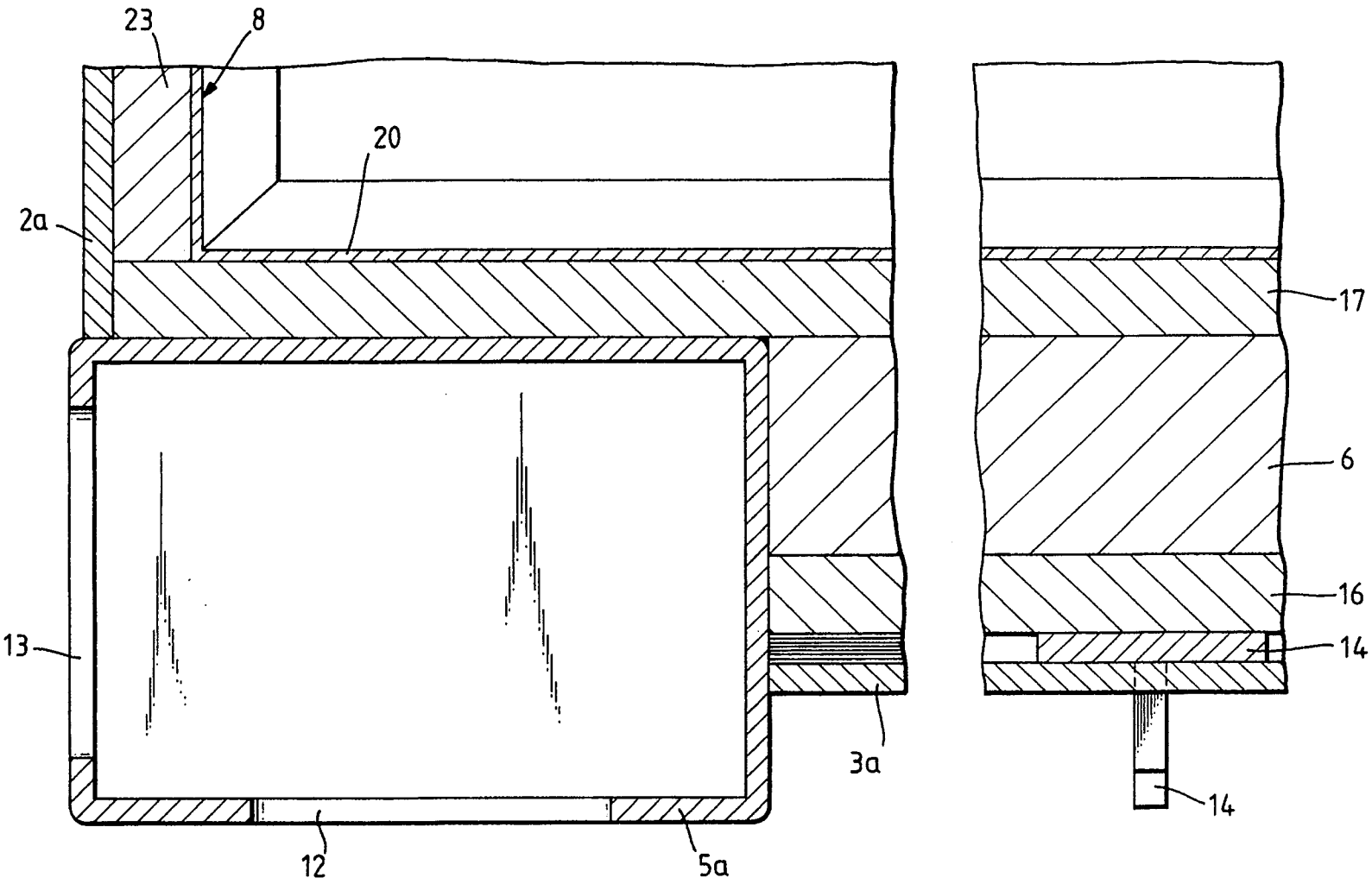
FIG. 8 is a cross-section along lines viii—viii of FIG. 6.

FIGS. 7 and 8 show in more detail the construction of the corner units and how they are fitted to the beams. As can be seen beam 3*a* is L-shaped in cross-section. It is fixed to corner piece 5*a* by welding. 5*a* consists of a generally box-shaped unit, the three externally facing surfaces being provided with apertures, 11, 12 and 13. These are of a standard shape for admitting standard container-handling equipment, for instance of cranes for lifting the container or of locking units for locking it onto transportation vehicles, such as trains or lorries. They are thus rectangular so as to be capable of admitting generally rectangular components which can then be twisted to lock them within the corner box. To the long horizontal beam 3*a* there are fitted a plurality of horizontal struts, through one of which, 14, the section is taken. This cross strut has for most of its length a T-section, but has no leg at the ends where the strut is fixed to the horizontal part 15 of the beam 3*a*. The T-section gives the beam strength for supporting the floor of the transportation unit. On to these cross struts there is first placed a layer of plywood 16, for instance 16 mm plywood. On to the top of the plywood layer 16 there are positioned the two roof trusses, 6 and 7 illustrated in FIG. 1, one of which, no. 6, is illustrated in FIG. 7. This truss is bolted to the side beam 3*a* at various positions along its length and is generally bolted to the second truss, 7, at a plurality of positions along their abutting edges. For protection of the roof trusses, a further layer of plywood 17 is placed over them.

There is also welded to the corner unit 5*a* a vertical beam, 2*a*. The side wall of the transportation unit has an outer layer of plywood, 18. Wall panels for the house, comprising an outer facing 19, a metal frame 20 and metal sheets 21 and 22 fitted within the frame. Other panels are stacked vertically alongside the illustrated wall panel 8.

FIG. 8 illustrates a section along line VIII—VIII in FIG. 7. This shows a corner unit 5*a* having an aperture 12 in its lower surface and an aperture 13 in the surface facing outwardly at the end of the container transportation unit. To the corner unit there are secured by welding vertical beam 2*a* and horizontal beam 3*a*. Also welded to the corner unit is horizontal transverse beam 3*b* which is behind the corner unit in the diagrams and so is not shown. At a distance away from the corner unit along beam 3*a* there is secured a cross beam 14 having a T-shaped cross section. This beam supports the floor of the transportation unit which is provided by an outer covering of plywood 16 and diagonal struts, provided by triangular roof truss 6. A further sheet of plywood, 17 is placed on top of the roof truss 6. The end wall of the transportation unit also has a covering of plywood, 23. Wall panels, including wall panel 8 are stacked vertically parallel with the side walls.

Figure 5:
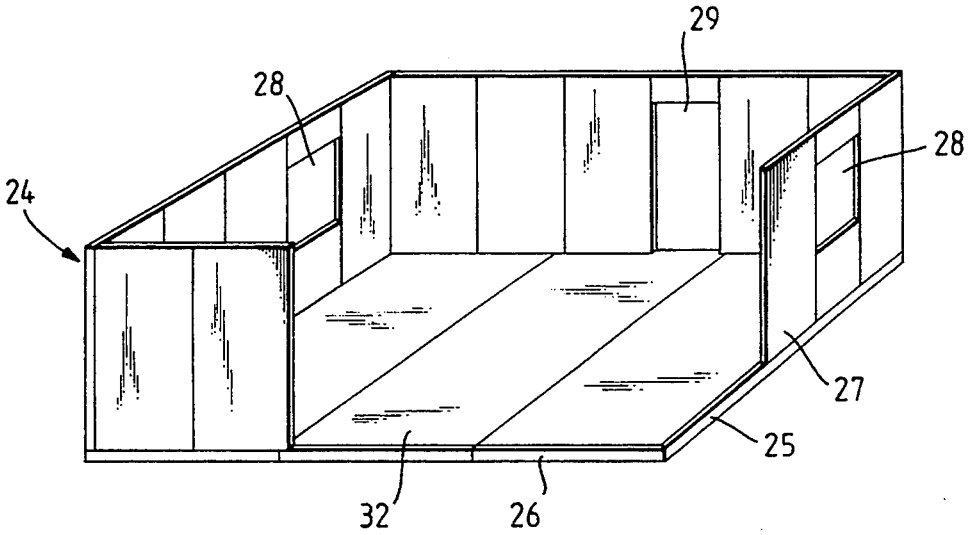
FIG. 5 is a perspective view of a partially constructed building.
Figure 6:
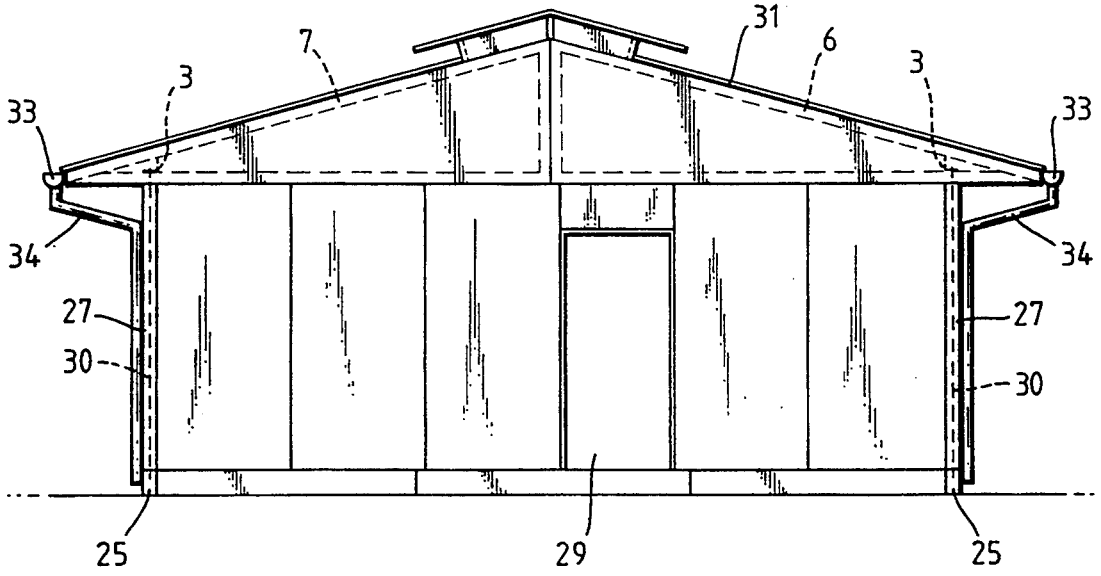
FIG. 6 is a side view of a fully constructed building.

FIGS. 5 and 6 illustrate generally one type of shelter that may be constructed from the components packed into the transportation unit kit. FIG. 5 shows a shelter 24 in partially constructed form. It consists of a portable foundation comprising beams 25 and 26 which are secured to the ground and which are secured to each other by fixing plates, generally at least at the corners. Wall panels 27 are supported on the portable foundation beams by interlocking securing means, not shown in the diagram. Some of the wall units have window openings 28, and others have door openings 29. When all of the wall panels are fitted onto the portable foundation the roof is applied. The roof consists of triangular roof trusses 6 and 7, which have been used as diagonal struts in the base of the transportation unit, as further illustrated in FIGS. 1, 6 and 7. These triangular roof trusses are secured to each other along their abutting portions. The roof trusses are secured above the walls by L-shaped beams 3 which are secured to the trusses, 6 and 7, wall panels 27 and portable foundation beams 25 by long bolts 30. The L-shaped beams are the beams used to form the frame of the transportation unit. The roof may be stabilised against the wind by the provision of struts, for instance across the ceiling of the shelter. Conveniently these struts are formed by the T-shaped beams 14 illustrated in FIGS. 6 and 7, used to support the floor of the transportation unit.

The roof of the shelter is finished by covering with a layer of plywood, 31, using the plywood from the transportation unit. Plywood can also be used as a floor covering 32. In the shelter shown, there are also provided gutters 33 and drainpipes 34.

In the kit shown, all of the components of the transportation unit, including the bolts used to secure components to each other during transport, are used in the construction of the shelter. Before use of the beams 3 in the building, the corner units 5 are severed from the beams, for instance using a conventional implement for cutting steel, such as a disk grinder. The corner units can also be used as components of the building, for instance as structural components for supporting cooking apparatus. The transportation unit is packed in a way that allows components to be used in approximately the order in which they are required for constructing the building. Thus the portable foundation beams 25 and 26 can be removed from the transportation unit at an early stage and can be secured to the ground. The wall panels 8 and 9 can then be removed from the transportation unit and secured onto the portable foundation, the roof trusses 6 and 7 then being fitted above the walls. The L-shaped beams 3 are the last components to be dismantled from the transportation unit and are not required until the final stages of the construction of the building.

Preferably the components of the kit are the components of the kit described in the application filed even date by the same applicant entitled Prefabricated Building published as W09003475, the entire disclosure of which is herein incorporated by reference.

Figure 9:
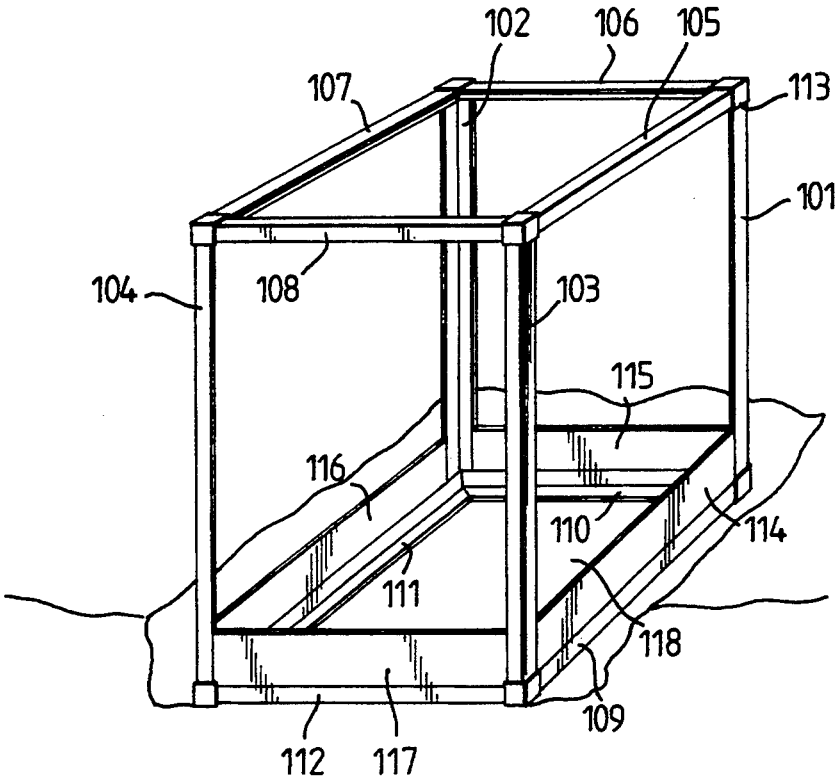
FIG. 9 is a perspective view of the frame of an alternative embodiment of transportation kit.

FIG. 9 shows the frame of an alternative embodiment of the invention. The frame consists of four upright beams 101, 102, 103, 104, each being L-shaped in section. The frame further consists of four top, horizontal L-shaped beams 105 to 108, and four bottom horizontal L-shaped beams, 109 to 112. These 12 beams are attached together to form a cuboidal at the eight corners by standard container box corner units, 113. These are of the same structure as those shown in the previous figures.

The cuboidal frame in addition comprises partial wall panels, 114 to 117, which are permanently joined to the respective bottom horizontal beams and the lower parts of the horizontal beams. Thus these wall panels are fixed in the position shown during use of the containerized transportation unit and when the building is erected. The cuboidal frame otherwise has open walls and roof, as well as an open floor, 118.

The cuboidal frame of this embodiment of the invention is not dismantled before it is used as part of the prefabricated building. The rigid frame may for instance be used as a basis for a side room. FIG. 9 shows the frame set in a hole dug in the ground so that the floor is around 50 cm below normal ground level. The earth will be filled to normal ground level around the wall panels. Side panels may be added to complete the walls, as well as the ceiling. Preferably the floor is left at least partially open to transmittal of water vapour from the ground into the inside of the room. Some of the floor may be covered by floor covering, for instance arranged at around ground level. At least part, however, is covered by gravel or other covering allowing moisture to pass through. This ensures that the space within the room remains cool and that the room is suitable for storage of, for instance food and drink.

The cuboidal frame of the side room, being rigid and strong (because it has been used as part of the containerized transport unit), may be used to provide stability to the main building. This may be achieved, for instance, by attaching framework components of the main building to the cuboidal frame of the side room, and even, if desired, by utilising one of the walls and associated surrounding beams of the side room as a common wall, acting therefore also as a wall for the main building.

I claim:

1. A containerized prefabricated building kit comprising a) a cuboidal frame having eight: corners and twelve edges, front and back walls, two side walls, a floor and a roof, said cuboidal frame consisting of b) eight corner box units, one of which is positioned at each of the eight frame corners, each being box-shaped with six faces and having three external faces which face outwards from the kit and three internal faces; and c) twelve elongate beams forming said frame edges, each of which has first and second ends, said first and second ends each being rigidly secured to one internal face of said box-shaped corner pieces, d) in which said cuboidal frame is at least 2.6 m high, e) said side walls each being formed by several kit wall panels, each panel having an area of less than 6 $m^2$, which are removably attached to the said frame, f) said front and back walls and roof and floor being formed of components which are not permanently secured to said frame.

g) said kit further containing a plurality of building panels for use in the prefabricated building as building wall panels, floor panels and roof panels.

h) said kit further containing a plurality of building beams for use in the prefabricated building as structural load bearing components, i) in which said prefabricated building has a total floor area which is more than twice the area of the floor of the containerized kit.

2. A kit according to claim 1 in which the total floor area of the prefabricated building is more than four times the area of the floor of the containerized kit.

3. A kit according to claim 1 in which said cuboidal frame is at least 2.7 m high.

4. A kit according to claim 1 in which said cuboidal frame is about 2.9 m high.

5. A kit according to claim I in which the cuboidal frame is about 2.44 m wide.

6. A kit according to claim 4 in which the cuboidal frame is about 2.44 m wide.

7. A kit according to claim 1 in which the length of the cuboidal frame is in the range about 4.5 m to about 12.1 m.

8. A kit according to claim 4 in which the length of the cuboidal frame is in the range about 4.5 m to about 12.1 m.

9. A kit according to claim 1 in which the length of the cuboidal frame is in the range about 4.5 m to about 12.1 m and the cuboidal frame is about 2.44 m wide.

10. A kit according to claim 4 in which the length of the cuboidal frame is in the range about 4.5 m to about 12.1 m and the cuboidal frame is about 2.44 m wide.

11. A kit according to claim 1 containing also preformed triangular roof trusses.

12. A kit according to claim 1 in which said elongate beams are each L-section having a reverse angle which is external.

13. A kit according to claim 1 in which each of said building panels are arranged to stand substantially vertically inside the frame.

14. A kit according to claim 1 in which each of said building panels has an area of less than 6 $m^2$.

15. A method of erecting a building from prefabricated components comprising the steps of:

i) providing the said components in the form of a containerized kit comprising a) a cuboidal frame having eight corners and twelve edges, front and back walls, two side walls, a floor and a roof, said cuboidal frame consisting of b) eight corner box units, one of which is positioned at each of the eight frame corners, each being box-shaped with six faces and having three external faces which face outwards from the kit and three internal faces; and c) twelve elongate beams forming said frame edges, each of which has first and second ends, said first and second ends each being rigidly secured to one internal face of said box-shaped corner pieces, d) in which said cuboidal frame is at least 2.6 m high, e) said side walls each being formed by several kit wall panels, each panel having an area of less than 6 $m^2$, which are removably attached to the said frame, f) said front and back walls and roof and floor being formed of components which are not permanently secured to said frame.

g) said kit further containing a plurality of building panels for use in the prefabricated building as building wall panels, floor panels and roof panels.

h) said kit further containing a plurality of building beams for use in the prefabricated building as structural load bearing components, ii) dismantling the said containerized kit by removing said building panels and said building beams, and detaching said kit wall panels from said frame, and iii) erecting the said building from said building panels, building beams and kit wall panels to form a building having external walls and a roof in which the floor area of the building bounded by the said external walls is more than twice the floor area of the containerized kit.

16. A method according to claim 15 in which the total floor area of the prefabricated building is more than four times the area of the floor of the containerized kit.

17. A method according to claim 15 in which said cuboidal frame is dismantled by separating the said elongate beams and corner box units from one another.

18. A method according to claim 17 in which each of said elongate beams is separated from the corner box units at both its first and second ends.

19. A method according to claim 15 in which said cuboidal frame is used as a structural component of the building without separating said elongate beams and corner box units.

* * * * *

UNITED STATES PATENT AND TRADEMARK OFFICE

CERTIFICATE OF CORRECTION

PATENT NO. : 5,447,000
DATED : September 5, 1995
INVENTOR(S) : Peter W. Larsen

It is certified that error appears in the above-indentified patent and that said Letters Patent is hereby corrected as shown below:

On title page, item

--[30] Foreign Application Priority Data:

Sept. 26, 1988 [GB] United Kingdom ... 8822561.0;

Sept. 26, 1989 PCT ... PCT/GB89/01127--

Signed and Sealed this

Twenty-sixth Day of March, 1996

*Attest:*

BRUCE LEHMAN

*Attesting Officer*

*Commissioner of Patents and Trademarks*